US006032333A

United States Patent [19]

Brüstle

[11] Patent Number: 6,032,333

[45] Date of Patent: Mar. 7, 2000

[54] HINGE

[75] Inventor: Klaus Brüstle, Höchst, Austria

[73] Assignee: Julius Blum Gesellschaft m.b.H., Höchst, Austria

[21] Appl. No.: 09/077,753

[22] PCT Filed: Nov. 15, 1996

[86] PCT No.: PCT/AT96/00225

§ 371 Date: Jun. 11, 1998

§ 102(e) Date: Jun. 11, 1998

[87] PCT Pub. No.: WO97/22773

PCT Pub. Date: Jun. 26, 1997

[30] Foreign Application Priority Data

Dec. 18, 1995 [AU] Australia ..... 686/95

[51] Int. Cl.[7] ..... E05D 7/04; E05D 7/10

[52] U.S. Cl. ..... 16/242; 16/240; 16/245; 16/258

[58] Field of Search ..... 16/240, 242, 245, 16/246, 258, 757, 271, 272

[56] References Cited

U.S. PATENT DOCUMENTS

| | | | |
|---|---|---|---|
| 3,041,657 | 7/1962 | McNinch . | |
| 4,653,144 | 3/1987 | Lautenschlager, Jr. | 16/240 |
| 4,674,148 | 6/1987 | Salice | 16/258 |
| 4,706,332 | 11/1987 | Lautenschlager, Jr. | 16/241 |
| 4,800,621 | 1/1989 | Röck et al. . | |
| 5,056,189 | 10/1991 | Brustle et al. | 16/258 |
| 5,245,727 | 9/1993 | Sasaki | 16/258 |
| 5,276,944 | 1/1994 | Lin | 16/258 |
| 5,603,142 | 2/1997 | Dubach et al. | 16/247 |

FOREIGN PATENT DOCUMENTS

| | | |
|---|---|---|
| 0 453 829 | 10/1991 | European Pat. Off. . |
| 86/02402 | 4/1996 | WIPO . |

*Primary Examiner*—Chuck Y. Mah
*Attorney, Agent, or Firm*—Wenderoth, Lind & Ponack, L.L.P.

[57] ABSTRACT

A hinge to mounted door on an article of furniture includes a base plate to be mounted on the article of furniture. An intermediate member is mounted on the base plate by a spring mechanism in the form of a tilting lever mounted on the intermediate member by a pivot and a spring biasing the tilting lever to pivot in a direction to lock the intermediate member on the base plate. A hinge arm is connected to the intermediate member for adjustment relative thereto. A mechanism to selectively adjust the hinge arm relative to the intermediate member in a direction longitudinally of the intermediate member includes plural projections on the intermediate member, the projections being spaced longitudinally of the intermediate member. Such mechanism further includes a disk rotatively mounted on the hinge arm and having an upper side to be engaged by an adjusting tool and a lower side having a cam in the form of a spiral web in engagement with the projections.

16 Claims, 8 Drawing Sheets

HINGE

BACKGROUND OF THE INVENTION

The invention relates to a hinge with adjusting devices, in which a hinge arm can be secured to a base plate by an intermediate member. The hinge arm is displaceable in the direction of the depth of an article of furniture, and is connected to a second hinge fastening part, for example a hinge cup, by an articulated lever of the like. The hinge arm has holes through which adjusting and/or securing means project. It is possible to hang the intermediate member, which is of U-shaped construction and laterally embraces the base plate with two lateral webs, into the base plate and to lock it by a spring mechanism mounted on the intermediate member. A disk with a preferably circular contour is rotatably mounted in the hinge arm, the disk having on its upper side a seat for an adjusting tool, preferably a crosstie screwdriver, and on its lower side an adjusting mechanism in the form of a cam which cooperates with the intermediate member to enable, by rotation, adjustment of the hinge arm. A hinge of this type is known from WO 86/02402.

Generally, a hinge arm has been secured on a base plate by a clamping screw. In order for an adjustment of the hinge arm in the direction of the depth of the article of furniture to be possible, this clamping screw has projected through an elongated hole in the hinge arm. The possibility for adjusting the hinge arm in the direction of the depth of the article of furniture has been determined by the length of this elongated hole.

Also known are snap connections for securing a hinge arm to a base plate. For example, DE-A 30 26 796 and DE-A 30 39 328 each disclose a hinge with a hinge arm and a base plate in which the two parts to be locked to one another snap into one another owing to insertion of the hinge arm into a guide of the base plate and displacement of the hinge arm in the longitudinal direction. DE-A 32 41 284 discloses a hinge in which a hinge arm can be pushed into lateral guides of a base plate and can be clamped on the base plate by means of an eccentric.

The hinges described above have the advantage that the hinge arm can be anchored on the base plate very quickly during assembly of the article of furniture and that, it is not necessary to use a tool for such mounting A disadvantage of these hinges in which the hinge arm or an intermediate member can be pushed onto the base plate from the front is that canting easily occurs. This is the case particularly with very high doors. Mounting is made even more difficult with a high door by the fact that more than two hinges are secured to the door.

In the case of a hinge of the type mentioned above, it is sufficient to press the hinge arm with the intermediate member onto the base plate during the mounting of the door. It is not necessary to use a screwdriver for securing the hinge arm. WO 86/02402 describes various hinges. In the case of the hinge which has, for adjustment of the hinge arm, a disk with an eccentric which enables a jerky adjustment, the hinge arm with the intermediate member is held on the base plate by a leaf spring. In order to be able to detach the hinge arm from the base plate, a screwdriver or a similar tool is required.

The same publication also discloses exemplary embodiments of a hinge arm in which a separate tilting lever is articulated on an intermediate member and is in turn acted upon by Spring. This tilting lever has a gripping part which enables separation of the hinge arm from the base plate without tools. If, in the case of this type of hinge, the position of the hinge arm on the base plate is to be corrected, a clamping screw must be released and the hinge arm subsequently displaced by hand. Since a hinge cup is anchored in the door during this adjustment, jerky movements very easily occur during the displacement of the hinge arm owing to the weight of the door, which makes it difficult to position the hinge arm precisely. Apart from the fact that the hinge arm can be detached from the base plate without tools by means of the separate tilting lever, this tilting lever has the advantage over a leaf spring of more precise anchoring in the locked position.

SUMMARY OF THE INVENTION

The object of the invention is to improve a hinge of the type mentioned above such that, in the case of a hinge arm which can be anchored on a base plate and detached without tools, it is possible to adjust the hinge arm in the direction of the depth of the article of furniture without jerky movements and at the same time ensure good guidance of the hinge arm.

Such object according to the invention is achieved in that a cam is constructed as a spirally running or extending web, against which projections of an intermediate member rest, which projections are offset in the manner of a rack in the longitudinal direction of the intermediate member, and in that a spring mechanism comprises a separate tilting lever which is acted upon by a spring and is mounted on the intermediate member by a pivot which projects at two ends thereof into longitudinal slots in lateral webs of the hinge arm.

In order to enable similarly accurate adjustment of the hinge arm in the direction of the height of the article of furniture, an exemplary embodiment of the invention advantageously provides for the base plate to be in two parts, with a lower part and an upper part displaceable thereon. A disk with a preferably circular contour is rotatably mounted in the upper part, the disk having on its upper side a seat for an adjusting tool, preferably a crosstip screwdriver, and on its lower side a spirally extending web, against which at least one projection of the lower part laterally rests.

BRIEF DESCRIPTION OF THE DRAWINGS

Exemplary embodiment of the invention is described below with references to the accompanying drawings, in which.

DETAILED DESCRIPTION OF THE INVENTION

Figure 1A:
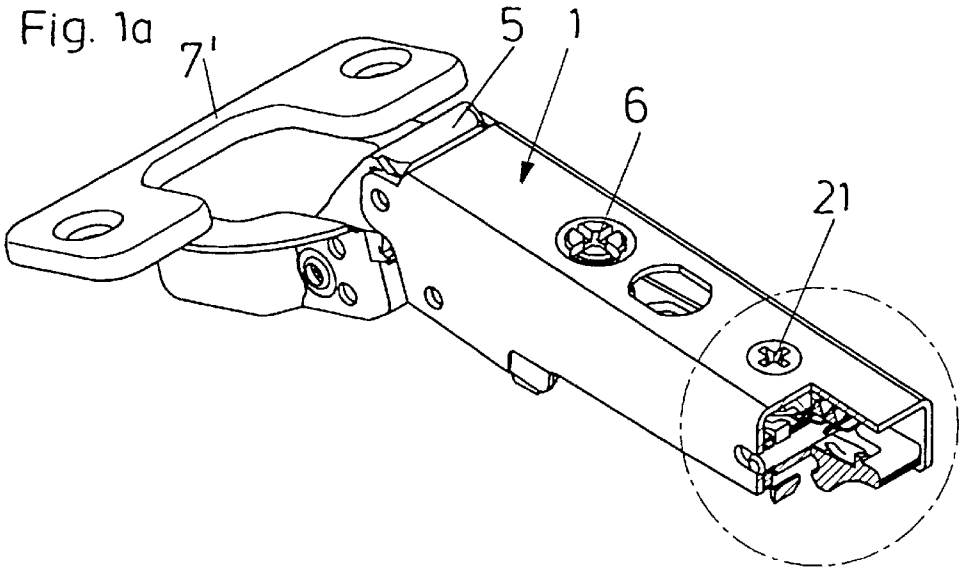
FIGS. 1*a* and 1*b* are perspective views, partially broken away, of a hinge arm of a hinge according to the invention.

As is apparent from the drawings, the parts of a hinge which are essential to the invention are hinge arm 1, base plate 2 and intermediate member 3, with tilting lever 4 and the disk 20, which serves for depth adjustment.

The hinge arm 1 is secured to the intermediate member 3 by a gap adjusting screw 6 threaded in the hinge arm 1. The gap adjusting screw 6 has a head 61 and projects by a neck through a forwardly open longitudinal slot 9 in the intermediate member. Depth adjustment of the hinge arm 1 is possible at most over the length of the longitudinal slot 9. By turning the gap adjusting screw 6, the hinge arm 1 is lifted to a greater or lesser extent from the base plate 2 and thus from side wall 13 or an article of furniture.

Both the hinge arm 1 and the intermediate member 3 have a U-shaped configuration. At the front, the intermediate member 3 is provided with a through pin 10 which serves as a holding projection of the intermediate member 3. The base plate 2 has at the front thereof a notch 11, into which the pin 10 can be hung so that it is held on the base plate 2.

Figure 1B:
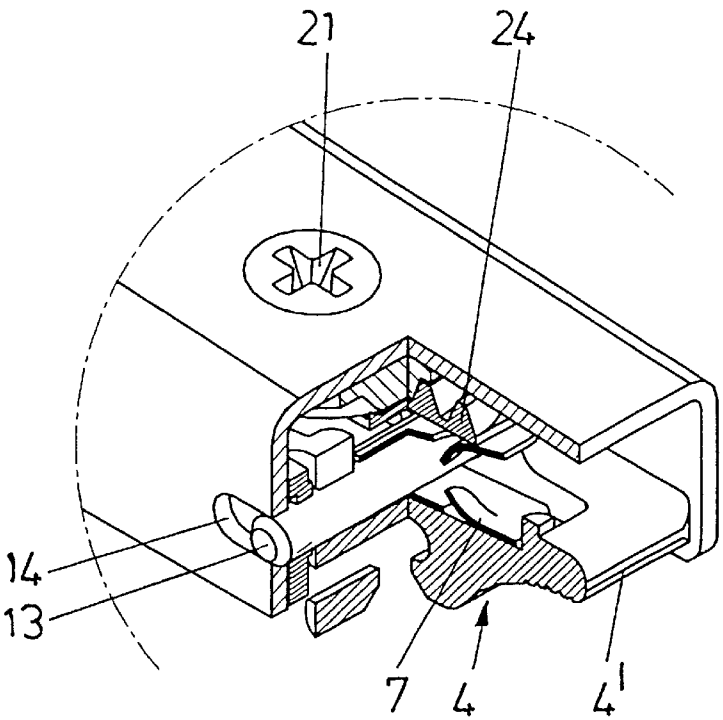
Figure 2:
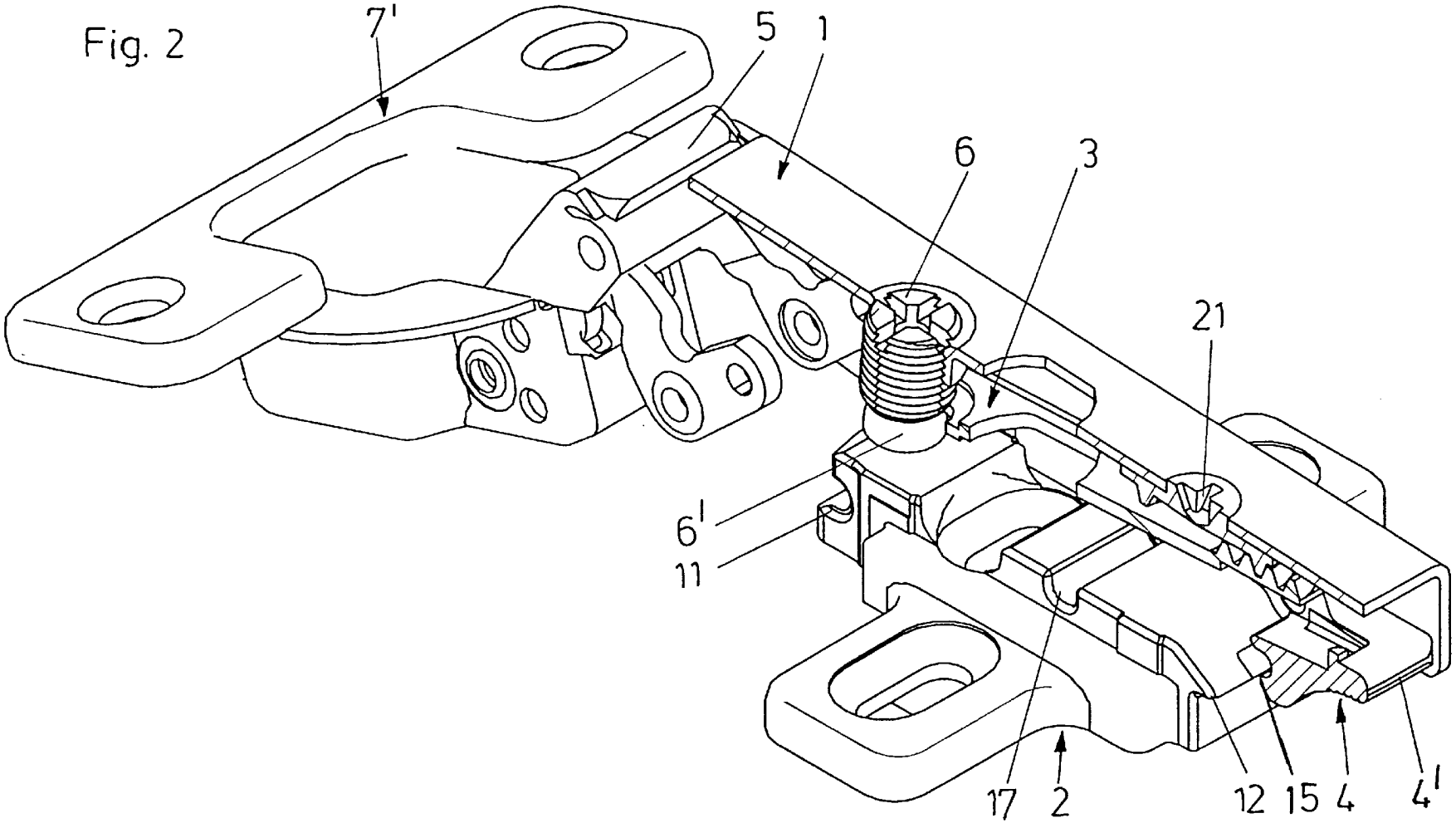
FIG. 2 is a perspective view of the hinge according to the invention, the hinge arm and an intermediate member being shown partially in section.
Figure 3:
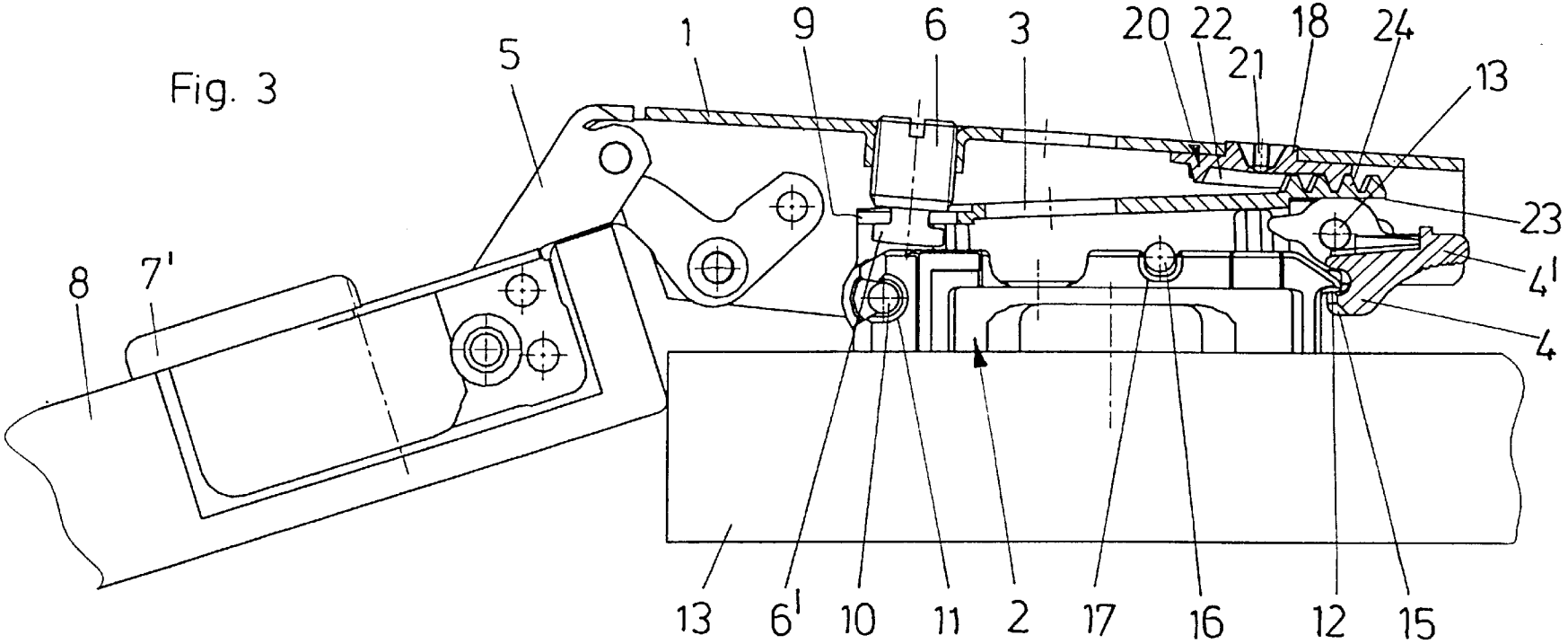
FIG. 3 is a side view of the hinge according to the invention, the hinge arm and the intermediate member being shown in a section.
Figure 4:
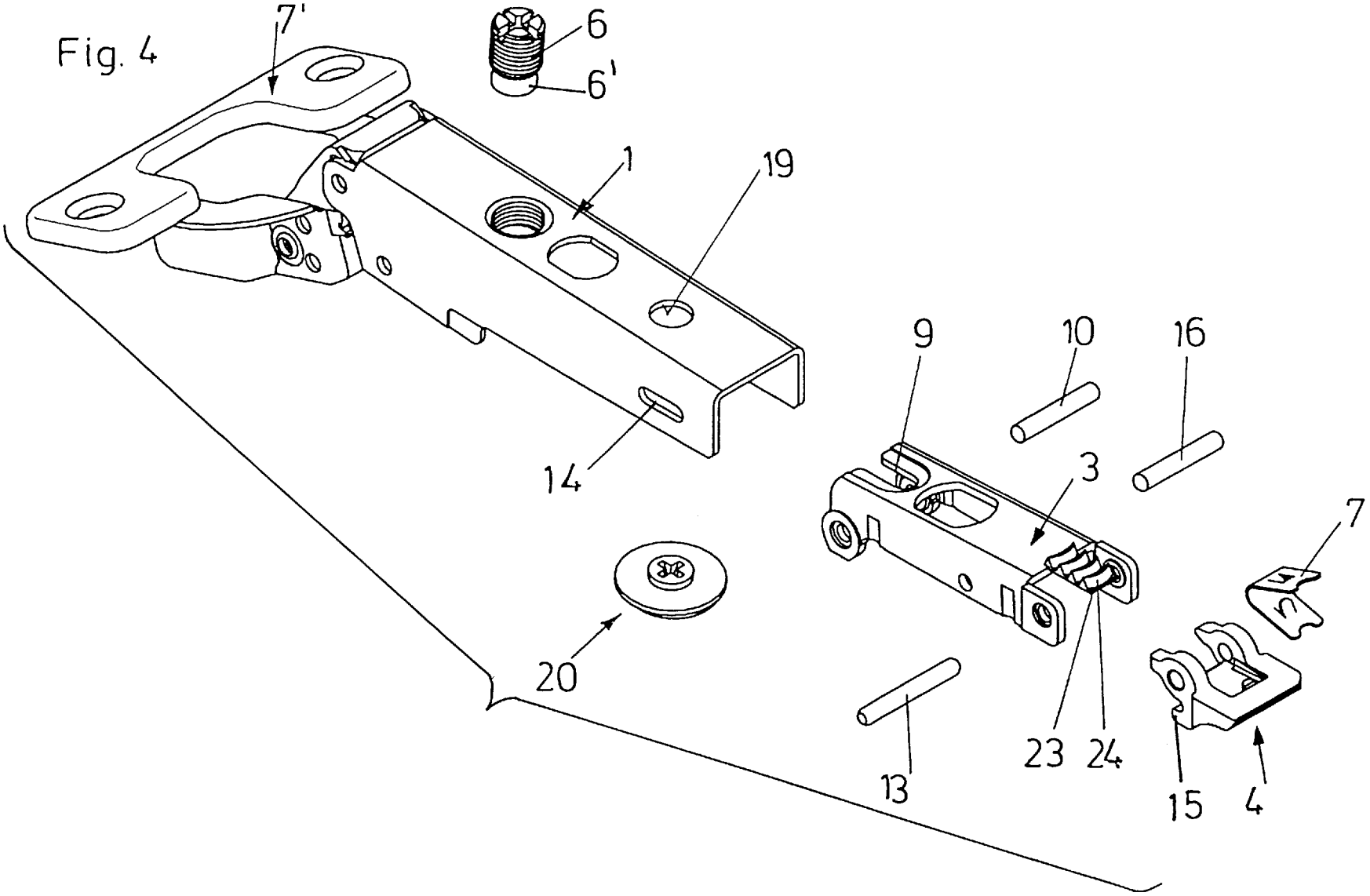
FIG. 4 is an exploded perspective view of parts of the hinge.
Figure 5:
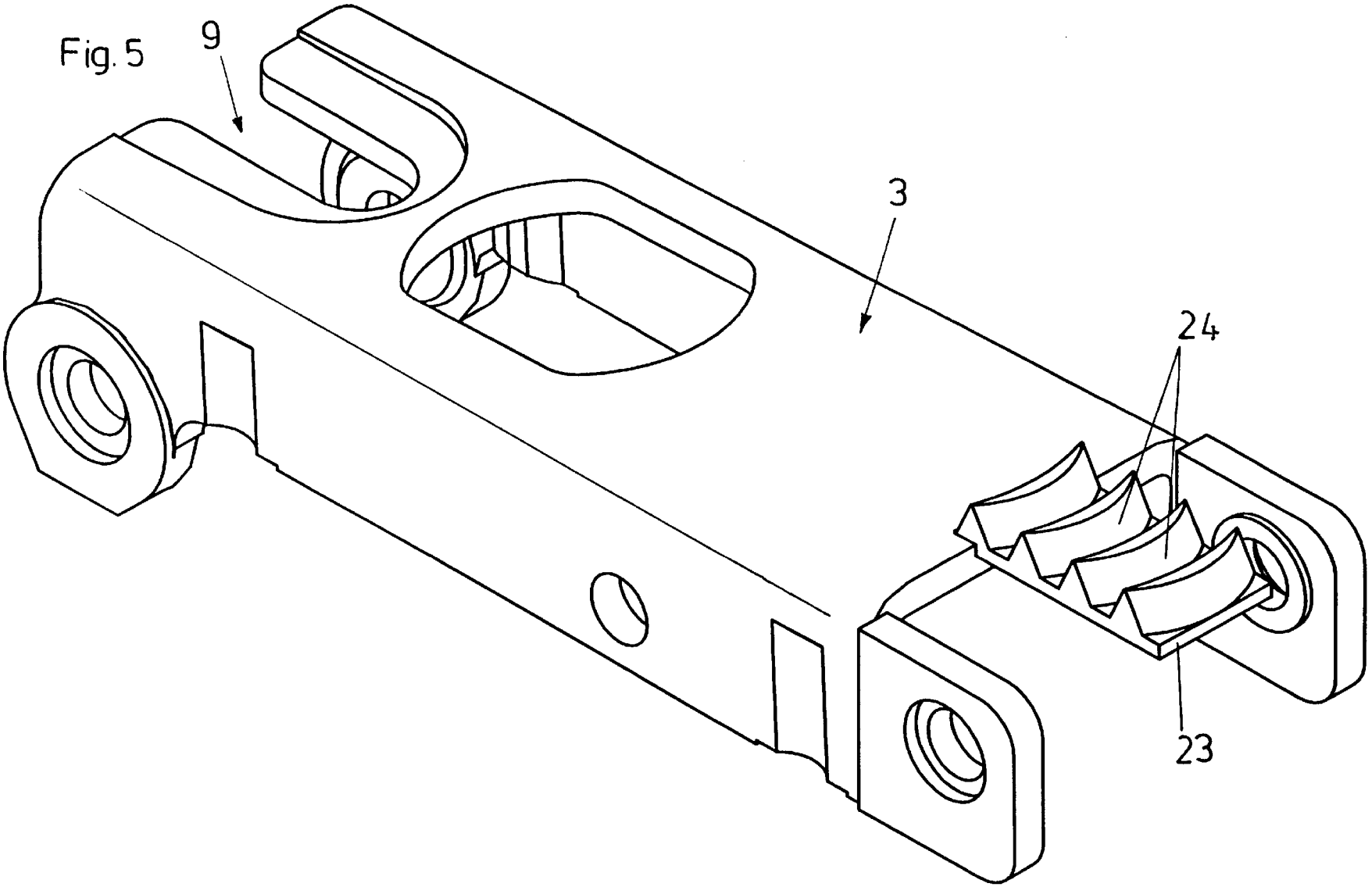
FIG. 5 is a perspective view of the intermediate member according to the invention.

The base plate 2 is provided at a rear end thereof with a projection 12. Tilting lever 4 is mounted on the rear end of the intermediate member 3 by a pivot 13. Lever 4 includes a hook 15 which engages on the projection 12 of the base plate 2 when the intermediate member 3 is positioned. The tilting lever 4 is acted upon by a spring 7 which can be supported on the intermediate member 3 or on the hinge arm 1. In the illustrated embodiment, the spring 7 is a U-shaped bent spring (FIGS. 1*b* and 4). If the hinge arm 1 with the intermediate member 3 first is anchored in the notch 11 at the front by the pin 10 and subsequently rotated clockwise (as viewed in the drawings) and pressed onto the base plate 2, the hook 15 of the tilting lever 4 engages at the projection 12 of the base plate 2, and the hinge arm 1 is anchored by the intermediate member 3 on the base plate 2.

A gripping part 4' is formed on the tilting lever 4. If the hinge arm 1 with the intermediate member 3 is to be detached from the base plate 2, it is sufficient to turn the tilting lever 4 counterclockwise by way of the gripping part 4', whereupon the holding projection or hook 15 clears the projection 12 of the base plate and the hinge arm 1 together with the intermediate member 3 can be lifted from the base plate 2. In order to ensure seating of the unit including hinge arm 1 and intermediate member 3 on the base plate 2 in a manner free from play in the longitudinal direction of the hinge arm 1, the intermediate member 3 is provided with a transverse pin 16 which engages in a notch 17 of the base plate 2. The depth positioning of the intermediate member 3 and thus of the hinge arm 1 is effected by the pin 10 and the pin 16.

The hinge arm 1 is connected to a hinge cup 7' in the conventional manner by way of articulated lever 5, and the hinge cup is to be inserted into a door 8. If the hinge arm 1 and with it the door 8 are to be adjusted in the direction of the door gap of the article of furniture, then it is sufficient to turn the gap adjusting screw 6, whereby the hinge arm 1 is lifted by its front end to a greater or lesser extent from side wall 13 of the article of furniture.

The adjustment of the hinge arm 1 in the direction of the depth of the article of furniture is effected by disk 20. In order that the hinge arm 1 can be displaced relative to the intermediate member 3 in the direction of the depth of the article of furniture, hinge arm 1 is held at its rear end on intermediate member 3 by pivot 13 on which the tilting lever 4 is mounted. The pivot 13 projects on both sides beyond lateral webs of the intermediate member 3 and into longitudinal slots 14 in lateral webs of the hinge arm 1. The disk 20 has a cylindrical boss or flange 18 which is received in a circular aperture 19 of the hinge arm 1. A seat 21 for a crosstip screwdriver is situated in boss 18. The lower side of disk 20 is provided with a spiral web or rib 22.

The intermediate piece 3 has at the rear thereof a weblike projection 23 having a series of projections 24. The projections 24 are designed as curved webs in the illustrated embodiment, the curvature being somewhat greater than the curvature of the rib 22 of the disk 20. Projections 24 could also be in the form of cylindrical pins. The projections 24 rest laterally against the rib 22 of the disk 20 and thus are, so to speak, interlocked therewith. If the disk 20 is turned using a crosstip screwdriver, the hinge arm 1 is displaced relative to the intermediate member 3 in the direction of the depth of the article of furniture. This adjustment is uniform, no jerky movement of the hinge arm 1 occurs, and special clamping of the hinge arm 1 to the intermediate member is not necessary. As a result, the possibility of gap adjustment of the hinge arm 1 remains completely unaffected by the depth adjustment of the hinge arm 1. The rib 22 and the projections 24 preferably have the same cross section. In the exemplary embodiment, the cross-sectional shape is substantially V-shaped.

Figure 6:
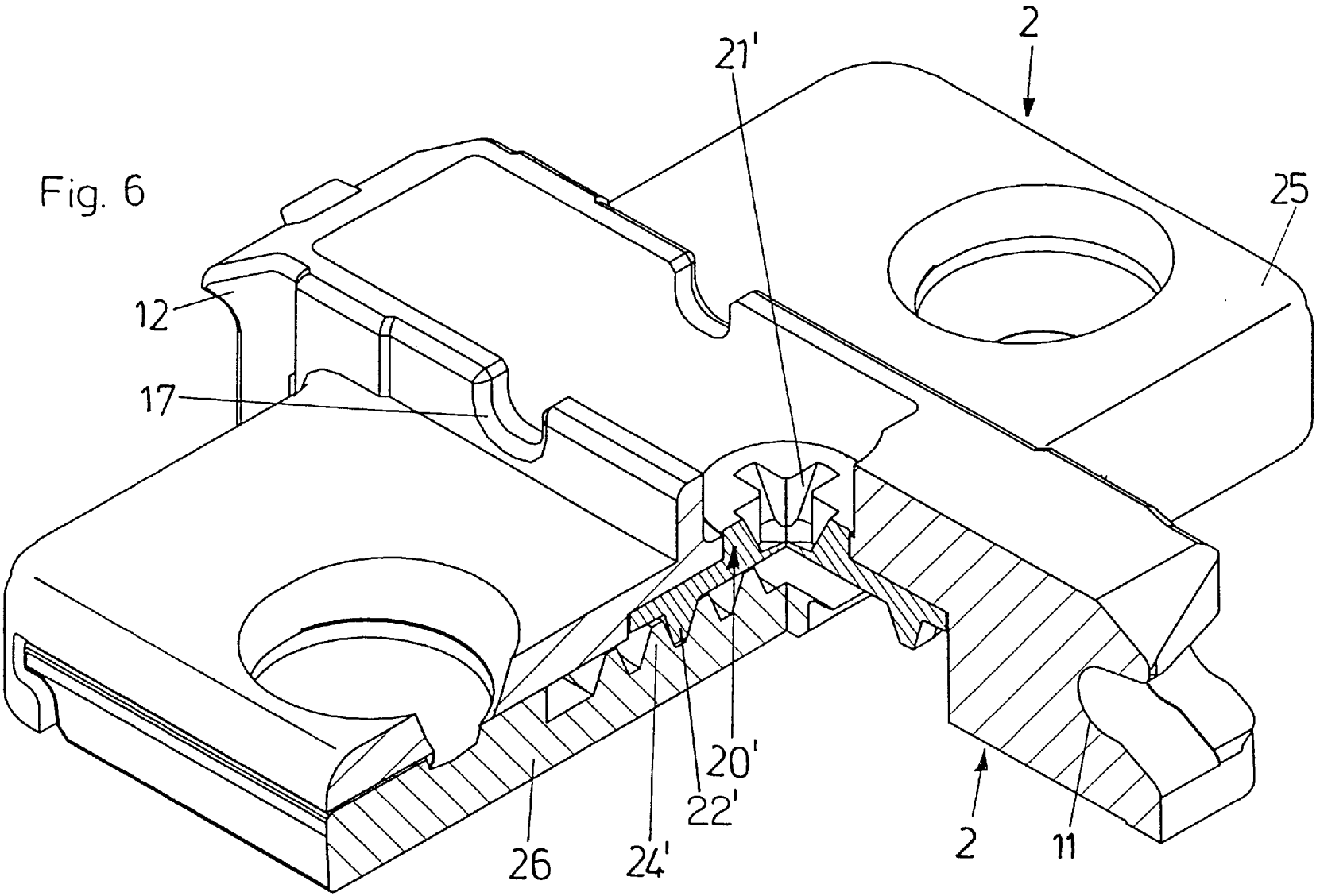
FIG. 6 is a perspective view of a two-part base plate, shown partially in section.
Figure 7:
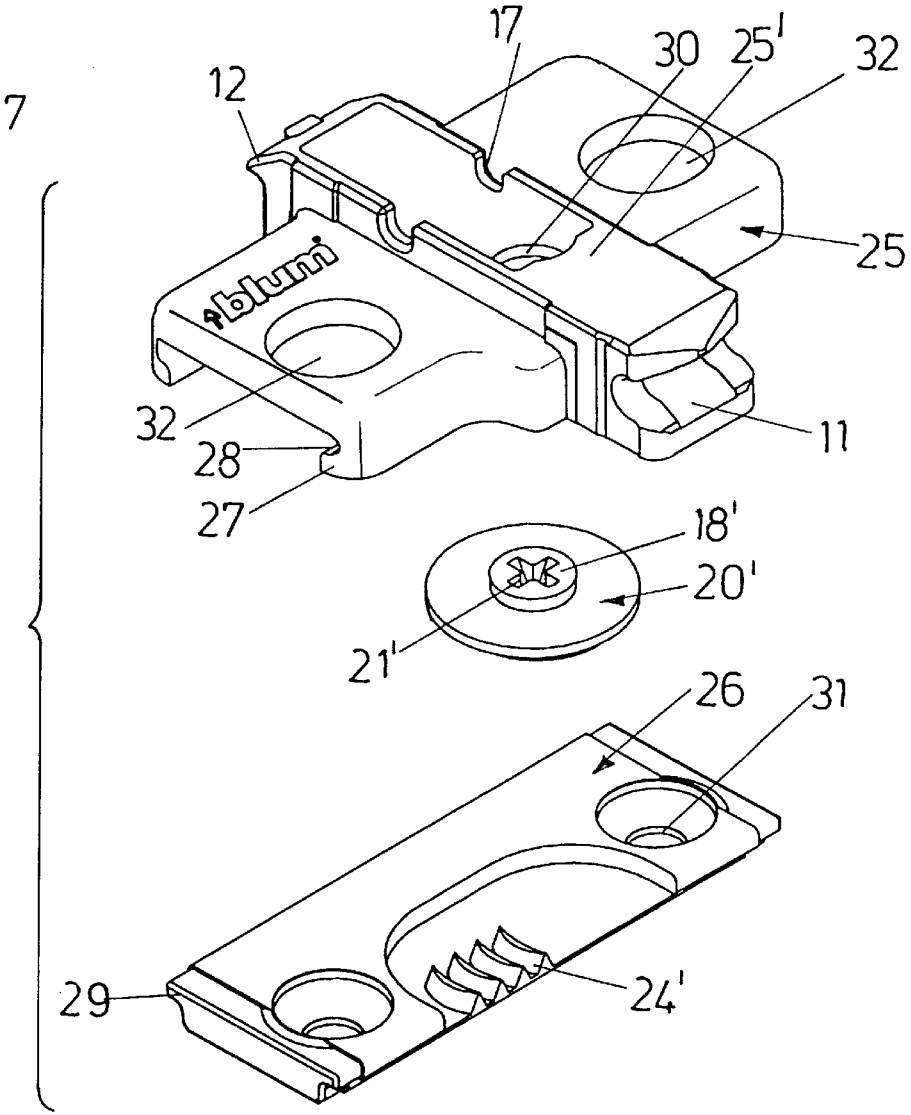
FIG. 7 is an exploded perspective view of the two-part base plate.
Figure 9:
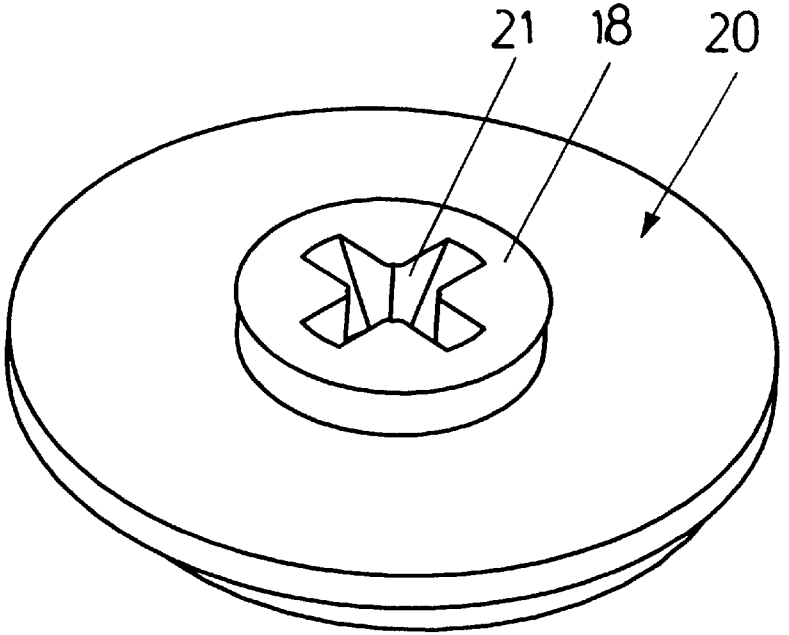
FIG. 9 is a perspective view of the disk seen from above.
Figure 8:
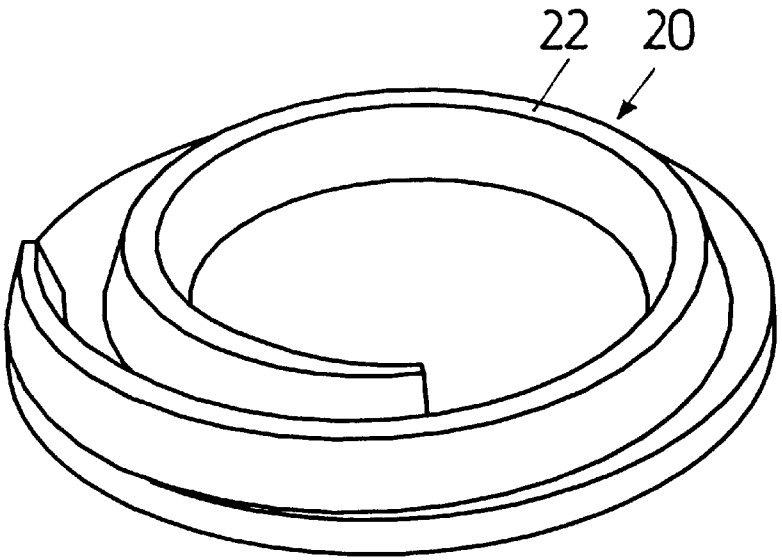
FIG. 8 is a perspective view of a disk seem from below.

In order to enable heigh adjustment of the hinge arm 1, the base late 2 in the embodiment of the invention shown in FIGS. 6 and 7 is constructed with two levels, i.e., an upper part 25 and a lower part 26. Situated on the upper part 25 is the notch 11, into which the pin 10 of the intermediate member 3 is fit, as well as projection 12. The upper part 25 additionally has, between the notch 11 and the projection 12, a central projecting region 25' in which is formed the notch 17 and which is embraced on both sides by lateral webs of the intermediate piece 3. The upper part 25 is furthermore provided with projection 27 which delimit grooves 28 in which is guided edges 29 of lower part 26. Formed on the lower part 26 in turn are projections 24' which are arranged in the form of teeth of a rack one above the other (relative to the mounted position of the hinge). Mounted in upper part 25 is 'disk 20', which is received by a boss or flange 18' thereof in an opening 30 of the upper part 25. Disk 20', in the same way as the disk 20 mounted on the hinge arm 1, is provided with a spirally extending rib 22' in engagement with projections 24 of the lower part 26. If the disk 20' is turned by means of a screwdriver, preferably a crosstip screwdriver, the upper part 25 is displaced in relation to the lower part 26 in the direction of the height of the article of furniture.

The lower part 26 is fixed to the side wall 13 of the article of furniture by screws or pegs (not shown) anchored in holes 31 of the lower part 26. The upper part 25 has holes 32 which enable a screwdriver to gain access to the screws which fix the lower part 26 to the side walls of the article of furniture.

Just like the depth adjustment of the hinge arm 1, the height adjustment of the hinge arm is also effected without jerking, so that particularly accurate positioning of the hinge arm 1 is possible.

I claim the following:

1. A hinge to be employed for mounting a door on an article of furniture, said hinge comprising:

a base plate to be mounted on the article of furniture;

an intermediate member having a U-shaped configuration defined by two lateral webs joined by a central web, said intermediate member being positionable on said base plate with said two lateral webs embracing said base plate;

a spring mechanism for mounting said intermediate member to said base plate, said spring mechanism including a tilting lever mounted on said intermediate member by a pivot having opposite ends projecting into slots in respective said lateral webs of said intermediate member, and a spring biasing said tilting lever to pivot in a direction to lock said intermediate member on said base plate;

a hinge arm pivotally connected to a hinge fastening part to be mounted on the door, said hinge arm being connected to said intermediate member for selective adjustment relative thereto;

a mechanism for selectively adjusting the position of said hinge arm relative to said intermediate member in a direction longitudinally of said intermediate member, said mechanism including plural projections on said intermediate member, said projections being spaced longitudinally of said intermediate member, and a disk rotatably mounted on said hinge arm, said disk having an upper side having a seat for an adjusting tool, and said disk having a lower side having a cam in the form of a spiral web in engagement with certain said projections, whereby rotation of said disk causes said spiral web to engage with other said projections spaced longitudinally of said certain projections, thus moving said hinge arm longitudinally of said intermediate member.

2. A hinge as claimed in claim 1, wherein a first end of said intermediate member has a pivot received in a recess in said base plate, and said tilting lever is mounted on a second end of said intermediate member.

3. A hinge as claimed in claim 2, wherein said tilting lever has a hook engageable with a projection on said base plate to lock said intermediate member on said base plate.

4. A hinge as claimed in claim 1, wherein said tilting lever has a hook engageable with a projection on said base plate to lock said intermediate member on said base plate.

5. A hinge as claimed in claim 1, wherein said plural projections comprise curved webs.

6. A hinge as claimed in claim 1, wherein said plural projections are formed on a web extending longitudinally from said central web of said intermediate member.

7. A hinge as claimed in claim 1, wherein said seat is configured to be engaged by a screwdriver.

8. A hinge as claimed in claim 1, wherein said disk has a circular configuration and is mounted for rotation in a circular opening in said hinge arm.

9. A hinge as claimed in claim 1, further comprising an adjusting screw threaded to said hinge arm and having a head engaging said intermediate member, such that rotation of said adjusting screw causes movement of said hinge arm toward and away from said intermediate member.

10. A hinge as claimed in claim 1, wherein said base plate has a two-part construction including a lower part to be mounted on the article of furniture and an upper part mounted on said lower part, and further comprising an adjusting mechanism for selective position adjustment of said upper part relative to said lower part in a direction transverse to said longitudinal direction of said intermediate member.

11. A hinge as claimed in claim 10, wherein said adjusting mechanism comprises at least one further projection on said lower part, and a further disk rotatably mounted on said upper part, said further disk having an upper side having a further seat for an adjusting tool, and said further disk having a lower side having a cam in the form of a spiral web in lateral engagement with said at least on further projection.

12. A hinge as claimed in claim 11, wherein said at least one further projection comprises plural further projections.

13. A hinge as claimed in claim 12, wherein said plural further projections are spaced in said transverse direction.

14. A hinge as claimed in claim 13, wherein said plural further projections comprise curved webs.

15. A hinge as claimed in claim 13, wherein said further seat is configured to be engaged by a screwdriver.

16. A hinge as claimed in claim 13, wherein said further disk has a circular configuration and is mounted for rotation in a circular opening in said upper part.

* * * * *

UNITED STATES PATENT AND TRADEMARK OFFICE

CERTIFICATE OF CORRECTION

PATENT NO. : 6,032,333

DATED : March 7, 2000

INVENTOR(S) : Klaus BRÜSTLE

It is certified that error appears in the above-identified patent and that said Letters Patent is hereby corrected as shown below:

On the title page, item [30], change "[AU] Australia" to --[AT] Austria--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*